US007544103B2

(12) United States Patent
Walter et al.

(10) Patent No.: US 7,544,103 B2
(45) Date of Patent: Jun. 9, 2009

(54) TERMINAL BLOCK FOR CONNECTING ELECTRICAL CONDUCTORS

(75) Inventors: Frank Walter, Blumberg (DE); Hermann Stadler, Donaueschingen (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 11/730,739

(22) Filed: Apr. 3, 2007

(65) Prior Publication Data

US 2007/0238303 A1 Oct. 11, 2007

(30) Foreign Application Priority Data

Apr. 5, 2006 (DE) ..... 10 2006 016 354

(51) Int. Cl.
*H01R 9/22* (2006.01)

(52) U.S. Cl. ..... 439/709; 439/441

(58) Field of Classification Search ..... 439/709, 439/441, 268, 721, 805, 835
See application file for complete search history.

(56) References Cited

U.S. PATENT DOCUMENTS

| | | | | | |
|---|---|---|---|---|---|
| 4,239,324 | A * | 12/1980 | Stenz | ..... | 439/716 |
| 5,192,234 | A * | 3/1993 | Heng et al. | ..... | 439/806 |
| 5,662,499 | A * | 9/1997 | Strack et al. | ..... | 439/709 |
| 5,741,161 | A * | 4/1998 | Cahaly et al. | ..... | 439/709 |
| 6,146,217 | A * | 11/2000 | Osada | ..... | 439/835 |
| 6,595,809 | B2 * | 7/2003 | Matsumoto et al. | ..... | 439/835 |
| 6,682,364 | B2 * | 1/2004 | Cisey | ..... | 439/441 |
| 6,806,424 | B2 * | 10/2004 | Gerving | ..... | 174/59 |
| 2007/0099480 | A1 * | 5/2007 | Fabian et al. | ..... | 439/441 |

FOREIGN PATENT DOCUMENTS

| | | |
|---|---|---|
| DE | 37 43 409 C2 | 6/1989 |
| DE | 295 00 614.5 U1 | 4/1995 |
| DE | 197 10 306 A1 | 8/1998 |
| DE | 198 03 085 A1 | 8/1999 |
| DE | 200 05 129 U1 | 6/2001 |
| DE | 203 01 369 U1 | 5/2003 |
| DE | 102 44 480 A1 | 4/2004 |
| DE | 20 2005 014 510 U1 | 1/2006 |
| DE | 10 2004 044 889 A1 | 3/2006 |
| EP | 1 240 687 B1 | 9/2002 |
| WO | 02/49158 A1 | 6/2002 |

* cited by examiner

*Primary Examiner*—Michael C Zarroli
(74) *Attorney, Agent, or Firm*—The Nath Law Group; Jerald L. Meyer; Jiaxiao Zhang

(57) ABSTRACT

A terminal block for connecting electrical conductors has a first clamping spring element (20) and a second clamping spring element (30) for clamping the electrical conductor. The first and second clamping spring elements (20, 30) are vertically offset from each other, and with an operating element for opening the clamping spring elements against the spring force. A first operating element (40) is provided for the first clamping spring element (20) and a second operating element (50) for the second clamping spring element (30). The first and second operating elements (40, 50) can be actuated independently from each other.

27 Claims, 8 Drawing Sheets

TERMINAL BLOCK FOR CONNECTING ELECTRICAL CONDUCTORS

RELATED APPLICATION

The present disclosure is co-pending with and simultaneously filed with U.S. patent application Ser. No. 11/730,740, titled "Terminal Block for Connecting Electrical Conductors", and which shares inventorship with the present disclosure.

FIELD OF THE INVENTION

The invention relates to a terminal block for connecting electrical conductors, with a first clamping spring elements vertically offset from each other, and with an operating element for opening the clamping spring elements.

BACKGROUND

DE 102 44 480 A1 discloses a terminal block for connecting electrical conductors, with first and second clamping spring elements configured as cage clamps for clamping the electrical conductors, wherein the first and second clamping spring elements can be disposed vertically offset from each other, and wherein an operating element is provided for opening the clamping spring elements against the spring tension. The terminal block according to DE 102 44 480 A1 provides a single pushbutton comprising first and second abutment surfaces, wherein the first abutment surface engages the first cage clamp and the second abutment surface engages the second cage clamp. The disadvantage of the terminal block is that the two clamping spring elements can only be opened together, which is associated with the risk that the two conductors clamped in the corresponding clamping spring elements are removed simultaneously, while only one conductor is supposed to be removed.

Also DE 197 10 306 A1 reveals an electric clamp for connecting electrical conductors, which clamp comprises first and second springs configured as leaf springs for clamping the electrical conductors, wherein the two springs are vertically offset from each other and an operating element is provided for opening the spring elements against the spring force. Also this operating element for opening the spring elements engages the two spring elements simultaneously, so that the two spring elements can only be opened together.

SUMMARY

It is therefore the object of the invention to provide a terminal block comprising at least two clamping spring elements, which block allows the individual clamping spring elements to be opened individually.

The object of the invention is achieved by a terminal block with the characteristics of a first operating element provided for the first clamping spring element and a second operating element for the second clamping spring element, the first and second operating elements being actuatable independently from each other.

Advantageous embodiments and further developments of the invention are disclosed in the dependent claims.

According to the invention, the terminal block comprises a first operating element for the first clamping spring element and a second operating element for the second clamping spring element, wherein the first and second operating elements can be actuated independently from each other. This way it is guarantee that each clamping spring element can be opened separately, even when the clamping spring elements are disposed on top of each other, so that only the respectively desired conductor can be removed, and not accidentally the second conductor.

It is preferable if the first and second clamping spring elements are disposed in an S-shaped contact element directly on top of each other with no lateral offset. This achieves a particularly space-saving configuration of the two clamping points.

A particularly simple actuating shape is achieved when the first and second operating elements are configured as translatory pressure elements. Operating elements of this type can be implemented with a particularly simple design.

Advantageously, the two operating elements are disposed parallel to each other, forming a particularly simple design.

The two operating elements are preferably disposed above the two clamping spring elements and one of the two operating elements is guided past the upper clamping spring element so as to actuate the lower clamping spring element. This way a particularly space-saving configuration of the clamping spring elements and the operating elements is achieved.

It is preferable if each operating element comprises an abutment surface, with which it engages a corresponding abutment surface of the respective clamping spring element to guarantee reliable actuation in the clamping spring elements by the operating elements.

It is preferable if each operating element comprises a pressure surface, to which pressure is applied for actuating the respective clamping spring element. It is particularly preferred if the pressure surfaces comprise a first recess, in which a working point of a tool, preferably a screwdriver, particularly preferred a flat head screwdriver, can be inserted. This way, it is possible to actuate the operating element also from a distance with a tool, for example, when it is not possible due to local circumstances to actuate the operating element directly with the finger. In an advantageous further development of the invention, these first recesses in the pressure surfaces of the two operating elements extend parallel to each other. This way it is guaranteed that upon insertion of a screwdriver exclusively the desired operating element, and not accidentally also the second operating element, is actuated.

In a particularly advantageous embodiment of the invention, the pressure surface comprises a second recess, wherein the two second recesses of the two operating elements are oriented in alignment with each other when the pressure surfaces of the two operating elements abut each other. In this case, it becomes possible to actuate both operating elements simultaneously by inserting a screwdriver in the second recess extending over the two pressure surfaces of the two operating elements, in the event that it is desired to open both clamping spring elements at the same time.

It is preferable if the second recesses are disposed perpendicular to the first recesses, since this can be implemented with a particularly simple design and prevents the accidental insertion of a screwdriver in the wrong recess.

According to a particularly advantageous further development of the invention, the first and second clamping spring elements are disposed in a common clamp housing, which comprises at least two feed-through openings for feeding the electrical conductors. The clamp housing serves as insulation for the clamping spring elements. It is particularly preferred if a plurality of first and second clamping spring elements are provided in the clamp housing to allow a plurality of clamping spring elements in an optimized space-saving configuration. It is preferable if the individual clamping spring pairs consisting of first and second clamping spring elements are electrically insulated from each other, thus guaranteeing that, if at all, only the clamping spring elements disposed on top of each other can be electrically connected, while the claming spring elements disposed adjacent to each other are insulated from each other.

According to an advantageous embodiment of the invention, the operating elements can be inserted in the housing through insertion openings, wherein they have a detent contour by means of which they snap into the clamp housing. This way, assembly of the terminal block and of the operating elements becomes particularly simple.

In an advantageous further development of the invention, the two clamping spring elements are electrically connected to each other, to enable simple connection of two conductors to the same potential. It is preferable if the electrically conductive connection of the two clamping spring elements is achieved by means of a contact element, which for this purpose is in contact with the two clamping spring elements.

According to a particularly preferred embodiment, the two clamping spring elements are electrically connected to each other by means of a substantially S-shaped contact element, wherein the two clamping spring elements can be inserted from one side into the S-shaped contact element, respectively. Thus, the clamping effect is established between the clamping spring elements and the S-shaped contact element, so that the clamping spring elements do not hit the insulating housing made of plastic, but instead the S-shaped contact element made to be electrically conductive. The spring forces of the clamping spring elements are then not conducted via the insulating housing, but via the S-shaped contact element, thus preventing deformation of the insulating housing and a decreased clamping effect. In a preferred embodiment of the invention, the S-shaped contact element is therefore made of electrically conductive material, which can absorb the spring forces of the two clamping points without deformation.

The S-shaped contact element is preferably configured as one piece, particularly preferred as a stamped and bent element, as a result of which the manufacturing costs for the S-shaped contact element are reduced.

According to a particularly preferred embodiment of the invention, the clamping spring elements are configured as leaf springs, since a leaf spring has the advantage that the electrical conductors can be inserted and contacted in the clamping point without prior opening of the clamping spring elements, allowing the electrical conductors to be connected with particular ease.

It is preferable if the clamping spring elements rest with a support surface against a support surface of the S-shaped contact element, guaranteeing the largest possible contact between the clamping spring elements and the S-shaped contact element and hence a particularly good electrically conductive contact.

In a particularly preferred embodiment of the invention, these support surfaces of the clamping spring elements have a structure, with which they engage a correspondingly shaped structure of the support surface of the S-shaped contact element with positive fit. This way it is guaranteed that the clamping spring elements cannot be displaced within the S-shaped contact element when inserting or removing electrical conductors. Furthermore, such a positive fit connection can be implemented particularly easily and cost-efficiently.

The terminal block can be implemented as a plug-in or soldering configuration. For this purpose, a plug contact or a soldering pin is preferably provided on the S-shaped contact element, in order to establish particularly good electrical contact.

It is particularly preferred if a test surface is provided on the S-shaped contact element, which surface can be used to test with particular ease whether the desired voltage is present on the S-shaped contact element and hence on the clamping spring elements.

To make the design of the terminal block even more space-saving, the S-shaped contact element in its upper region comprises a recess, in which the operating element for the lower clamping spring element is guided.

It is preferable if the clamp housing comprises a test opening, through which the test surface of the S-shaped contact element can be accessed.

According to an advantageous further development of the invention, graphical symbols are provided on the clamp housing in the vicinity of or on the operating element and in the vicinity of the feed-through opening of the appropriate clamping spring element, which allow an association of the operating element with the respective clamping spring element.

The invention will be explained hereinafter by way of example with reference the description of the figures, wherein:

DETAILED DESCRIPTION

Figure 1:
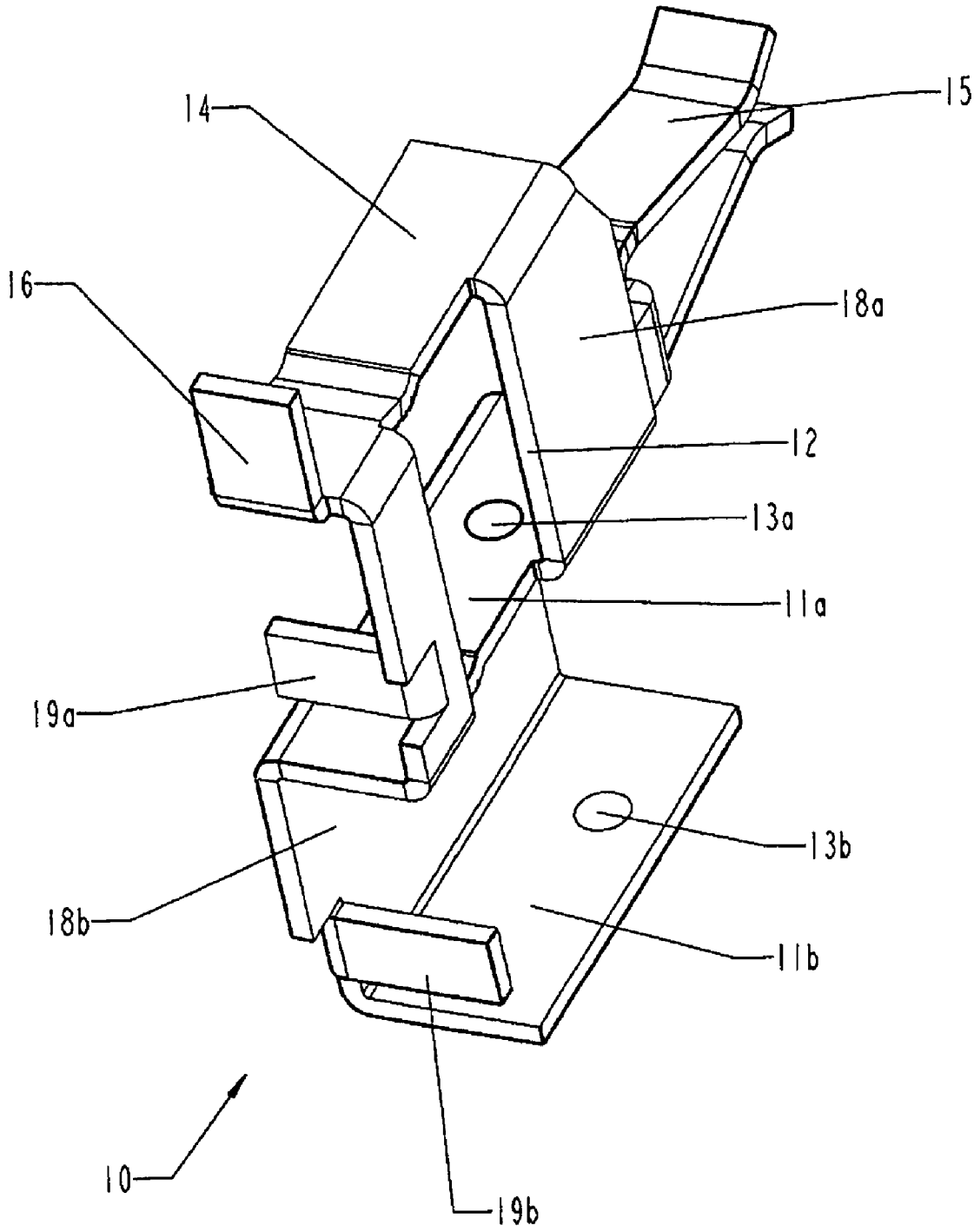
FIG. 1 is a perspective view of one embodiment of an S-shaped contact element.

FIG. 1 shows a perspective view of an S-shaped contact element 10, wherein an upper surface 14, a first support surface 11*a* and a second support surface 11*b*, each of which is configured in a substantially rectangular shape, are disposed parallel to each other and connected with each other via an upper lateral surface 18*a* and a lower lateral surface 18*b*. The upper lateral surface 18*a* connects the upper surface 14 and the first support surface 11*a* along one of their longitudinal edges, while the lower lateral surface 18*b* connects the first support surface 11*a* and the second support surface 11*b* along one of their longitudinal edges, while proceeding from the first support surface 11*a* the lateral surfaces 18*a*, 18*b* are provided on the two opposing longitudinal edges of the first support surface 11*a*. This produces the substantially S-shaped configuration of the S-shaped contact element 10. The S-shaped contact element 10 may be produced particularly cost-efficiently as a single-piece stamped and bent element. In particular, the S-shaped contact element 10 is made of electrically conductive material, wherein the material of the S-shaped contact element 10 can be selected such that the electrical conductivity properties are optimized. The S-shaped contact element 10 is therefore made of a copper alloy, for example.

On the first support surface 11*a* and the second support surface 11*b* a first structure 13*a* and a second structure 13*b* are provided, which are produced for example by embossing or punching.

On the upper lateral surface 11*a,* a plug contact 15 is integrally formed, which can be formed, for example, by two adjoining leaf springs and serves the connection of the S-shaped contact element to a conductor rail or the like.

On the upper surface 14, a test surface 16 is integrally formed, which is provided substantially perpendicular to the upper surface 14. The test surface can be used to determine whether voltage is present on the S-shaped contact element 10.

Figure 2:
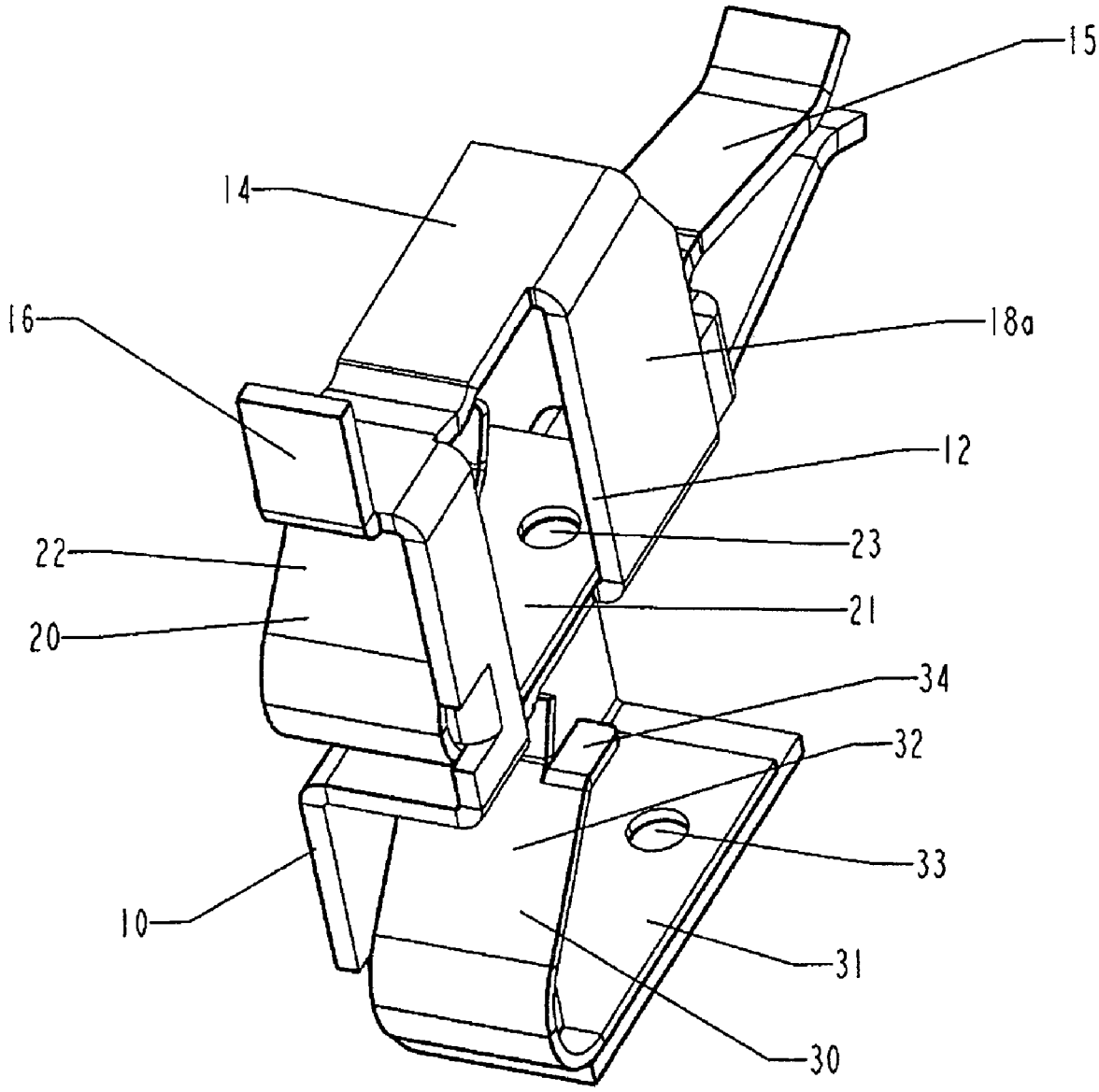
FIG. 2 is a perspective view of the S-shaped contact element according to FIG. 1 with inserted clamping spring elements.

The upper surface 14, the upper lateral surface 18*a* and the first support surface 11*a* define an upper space within the S-shaped contact element 10, in which a first clamping spring element 20 can be inserted from the open side, meaning from the side opposite the lateral surface 18*a,* as is illustrated in FIG. 2. Furthermore, the first support surface 11*a,* the lower lateral surface 18*b* and the second support surface 11*b* define a further lower space within the S-shaped contact element 10, in which a second clamping spring element 30 can be inserted from the open side (see FIG. 2). The open side of the lower space is located on the lateral wall of the S-shaped contact element 10, this wall being opposite the open side of the upper space.

The two clamping spring elements 20, 30 are configured as leaf springs and each comprise a support surface 21, 31 and a spring-loaded leg 22, 32 integrally formed thereon at an acute angle. The support surface 21 of the first clamping spring element 20 rests on the first support surface 11*a* of the S-shaped contact element 10, while the support surface 31 of the second clamping spring element 30 rests on the second support surface 11*b* of the S-shaped contact element 10. The spring-loaded leg 22 of the first clamping spring element 20 hits against the inside surface of the upper surface 14 of the S-shaped contact element 10, while the spring-loaded leg 32 of the second contact element 30 rests against the bottom of the first support surface 11*a* of the S-shaped contact element 10. The longitudinal axes of the clamping spring elements 20, 30 configured as leaf springs extend parallel to the longitudinal axes of the upper surface 14, the first support surface 11*a* and the second support surface 11*b.* The acute angle of the clamping spring elements 20, 30 opens toward the back of the S-shaped contact element 10. From the front of the S-shaped contact element 10 therefore two electrical conductors can be connected in the S-shaped contact element 10, which are inserted against the spring force of the spring-loaded leg 22, 32 of the respective clamping spring element 20, 30 in the space formed by the upper surface 14, the upper lateral surface 18*a* and the first support surface 11*a* and/or by the first support surface 11*a,* the lower lateral surface 18*b* and the second support surface 11*b.* The respective conductor is then clamped between the spring-loaded leg 22 of the first clamping spring element 20 and the upper surface 14 and/or the spring-loaded leg 32 of the second clamping spring element 30 and the bottom of the first support surface 11*a.* The clamping contact is thus created exclusively between metallic components, which can absorb the spring forces particularly well.

The clamping spring elements 20, 30 are likewise made of electrically conductive material, wherein the material can be selected such that the resilient properties of the clamping spring elements 20, 30 are optimized since the electrical contact between the connected conductor and a conductor rail or the like is optimized through the design of the S-shaped contact element 10.

The two clamping spring elements 20, 30 are disposed directly on top of each other in the S-shaped contact element, so that the two resulting clamping points can have a particularly space-saving configuration.

On their support surfaces 21, 31, the clamping spring elements 20, 30 are provided with structures 23, 33, which are formed by embossing or blanking, for example. As soon as the respective clamping spring element 20, 30 rests against the corresponding support surface 11*a,* 11*b* of the S-shaped contact element 10, these structures 23, 33 engage the corresponding structures 13*a,* 13*b* of the S-shaped contact element 10, thus securing the clamping spring element 20, 30 against displacement on the respective support surface 11*a,* 11*b* of the S-shaped contact element 10. In addition, a web 19*a* is integrally formed on the upper lateral surface 18*a* such that it is located perpendicular to the upper lateral surface 18*a,* wherein the web 19*a* rests at the apex of the acute angle of the first clamping spring element 20 upon insertion in the space formed by the upper surface 14, the upper lateral surface 18*a* and the first support surface 11*a,* which also results in fastening in the desired position within the S-shaped contact element 10. On the lower lateral surface 18*b* also a web 19*b* is integrally formed such that it extends perpendicular to the lower lateral surface 18*b,* so that the web 19*b* rests at the apex of the acute angle of the second clamping spring element 30 upon insertion in the space formed by the first support surface 11*a,* the lower lateral surface 18*b* and the second support surface 11*b,* which also secures the second clamping spring element 30 in its position relative to the S-shaped contact element 10. In particular, the webs 19*a,* 19*b* secure the clamping spring elements 20, 30 against displacement in the longitudinal direction of a conductor that is inserted in the corresponding clamping point.

Figure 3:
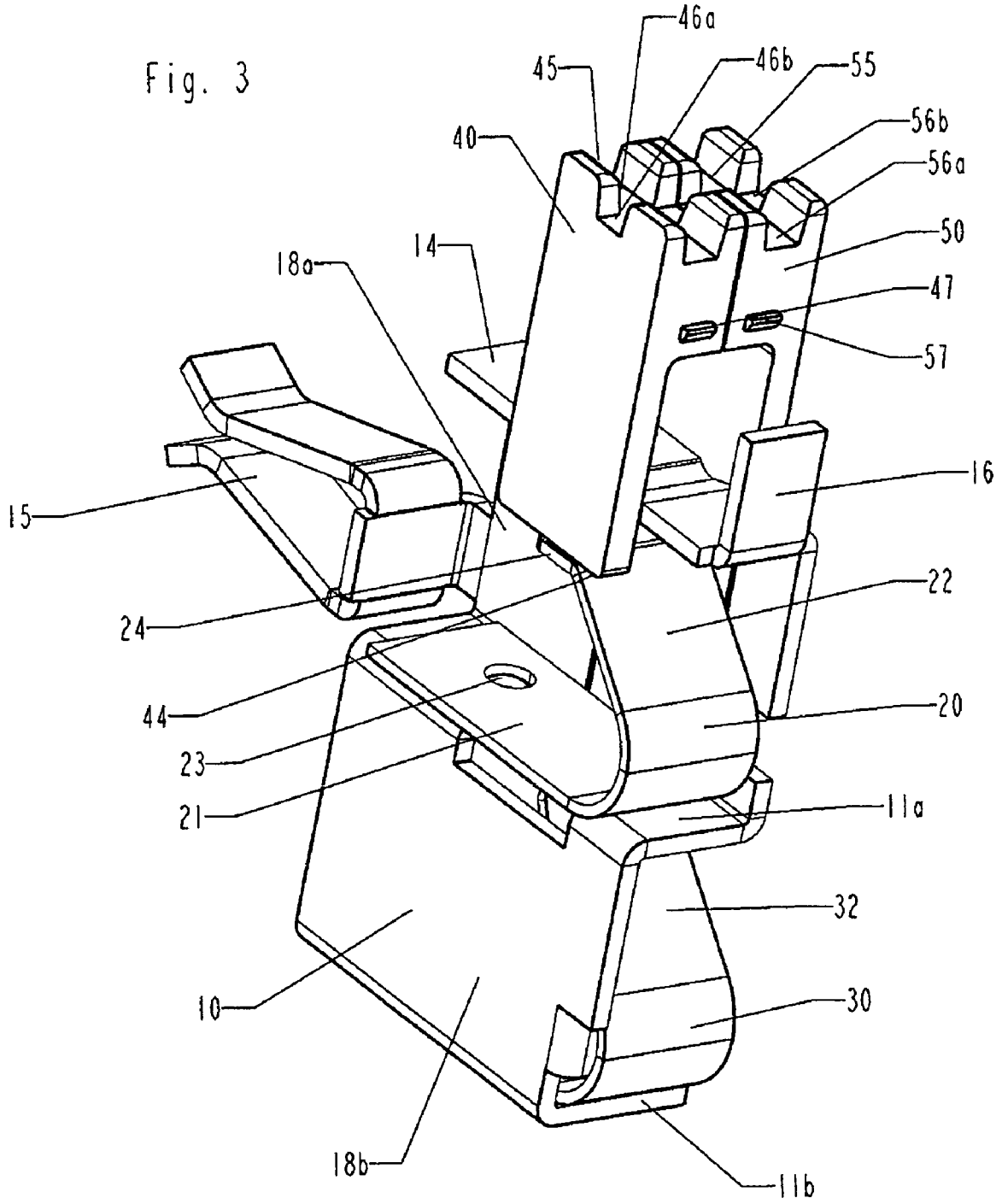
FIG. 3 is a first perspective view of the S-shaped contact element according to FIG. 1 with inserted clamping spring elements and operating elements.
Figure 4:
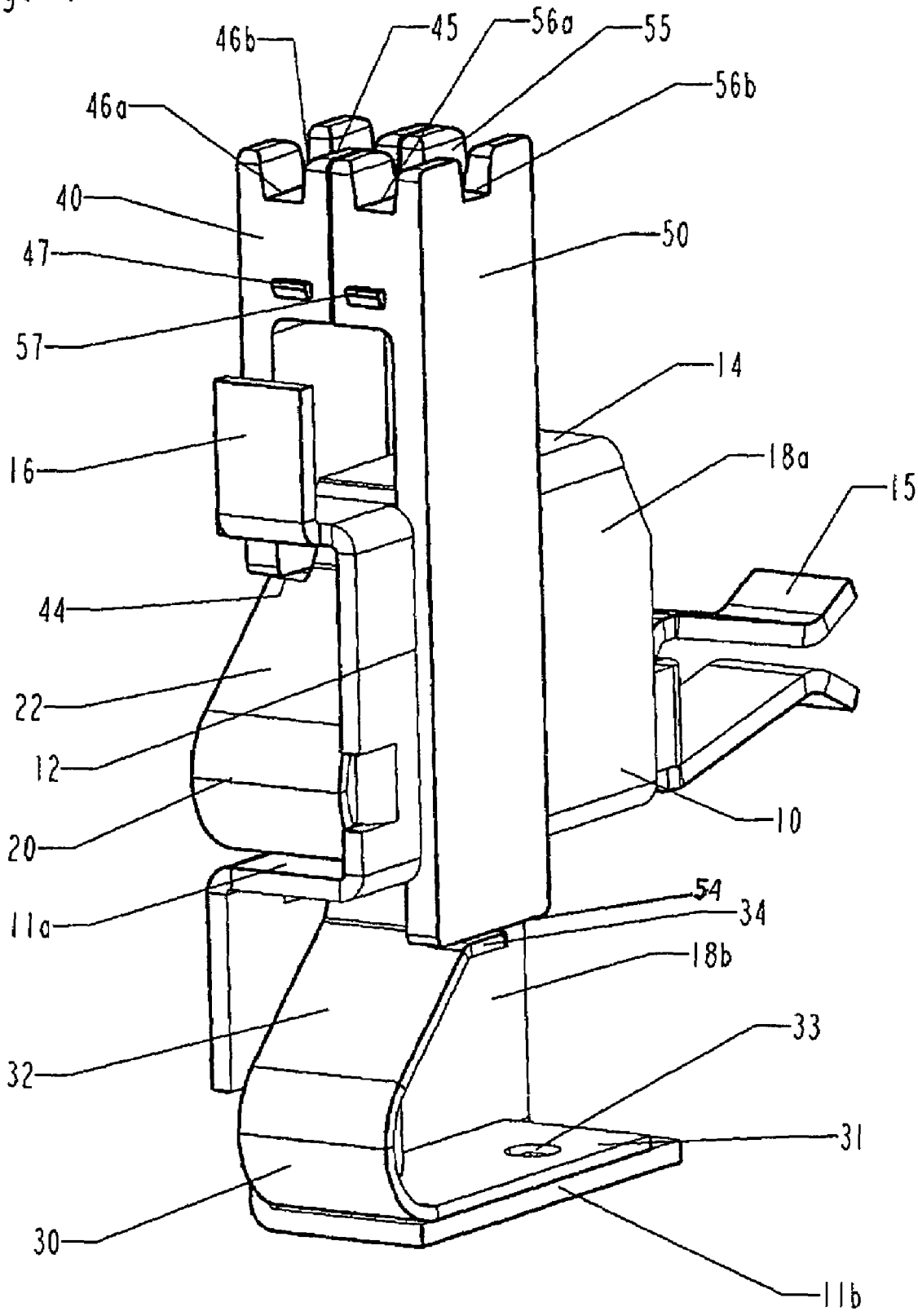
FIG. 4 is a further perspective view of the S-shaped contact element according to FIG. 3.

In order to be able to open the clamping spring elements 20, which are vertically offset from each other, independently from each other, for example to be able to remove an inserted conductor, above the clamping spring elements 20, 30 a first operating element 40, which can be used to actuate the first clamping spring element 20, and a second operating element 50, which can be used to open the second clamping spring element 30, are provided (see FIGS. 3 and 4). The configuration of the operating elements does not depend on whether the clamping spring elements 20, 30 are configured as leaf springs or, for example, as cage clamps and on whether the clamping spring elements 20, 30 are electrically connected to each other, particularly via the S-shaped contact element 10.

The operating elements 40, 50 are made of a substantially elongated cuboid, the one face sides of which comprise abutment surfaces 44, 54 for abutment with the corresponding clamping spring element 20, 30 and the opposite face sides of which comprise pressure surfaces 45, 55 for actuating the operating elements 40, 50.

The abutment surface 44 of the first operating element 40 engages an abutment surface 24 of the first clamping spring element, which surface is provided on the free end of the spring-loaded leg 22 of the first clamping spring element 20 and is located in the open side of the space formed by the first surface 14, the upper lateral surface 18*a* and the first support surface 11*a,* which side is opposite the open side 18*a.* The first operating element 40 thus engages the abutment surface 24 of the first clamping spring element 20 past the upper surface, while the pressure surface 45 of the first operating element 40 rests above the first clamping spring element 20 and particularly above the upper surface 14.

The second operating element 50 is disposed such that the pressure surface 55 likewise rests above the first clamping spring element 20 and particularly above the upper surface 14, wherein the second operating element 50 engages the second clamping spring element 30 past the first clamping spring element 20 and particularly past the upper surface 14 and the first support surface 11*a*. For this purpose, the second clamping spring element 30 comprises an abutment surface 34, which is provided on the free end of the spring-loaded leg 32 of the second clamping spring element 30 and points to the open side of the [space formed] by the first support surface 11*a*, the lower lateral surface 18*b* and the second support surface 11*b* of the S-shaped contact element 10. To ensure that the second operating element 50 can be configured in the best space-saving manner, the S-shaped contact element 10 in its upper region, particularly in its upper lateral surface 18*a*, comprises a recess 12, in which the second operating element 50 is guided (see FIG. 4).

The two operating elements 40, 50 are thus configured as pressure elements, which can be displaced along their longitudinal axes and thus form translatory pressure elements. The two operating elements 40, 50 can be actuated independently from each other, so that each individual clamping spring element 20, 30 can be opened individually in order to remove the conductor clamped therein, without the risk of accidentally also removing a conductor held in another clamping point.

In principle, the two actuating elements 40 or 50 are actuated by applying pressure on the pressure surface 45, 55, as a result of which the spring-loaded leg 22, 32 is removed from the appropriate support surface, namely the upper surface 14 or the bottom of the first support surface 11*a*, so that a conductor clamped therein can be pulled out. The pressure surfaces 45, 55 additionally comprise first recesses 46*a*, 56*a*, which extend parallel to each other and parallel to the longitudinal axis of the upper surface 14. The first recesses 46*a*, 56*a* are configured such that the working point of a tool, particularly a screwdriver, especially a flat head screwdriver, can be inserted in the first recesses 46*a*, 56*a*. As a result, each operating element 40, 50 can also be actuated by inserting the working point of the tool in the appropriate recess 46*a*, 56*a* and applying pressure on the operating element 40, 50 via the tool. This is particularly advantageous when the operating elements 40, 50 are not easily accessible. To allow the two operating elements 40, 50, if so desired, to be actuated also simultaneously, the pressure surfaces 45, 55 comprise second recesses 46*b*, 56*b*, which are configured perpendicular to the first recesses 46*a*, 56*a* and in alignment with each other via the respective pressure surface 45, 55. When the two pressure surfaces 45, 55 of the two operating elements 40, 50 directly abut each other, a flat head screwdriver can be inserted simultaneously in both second recesses 46*b*, 56*b* to be able to actuate both operating elements at the same time with particular ease. If only one operating element 40, 50 is supposed to be actuated, the flat head screwdriver is rotated by 90° and inserted in the first recess 46*a*, 56*a*, eliminating the risk of actuating the respectively other operating element 40, 50 at the same time.

Figure 5:
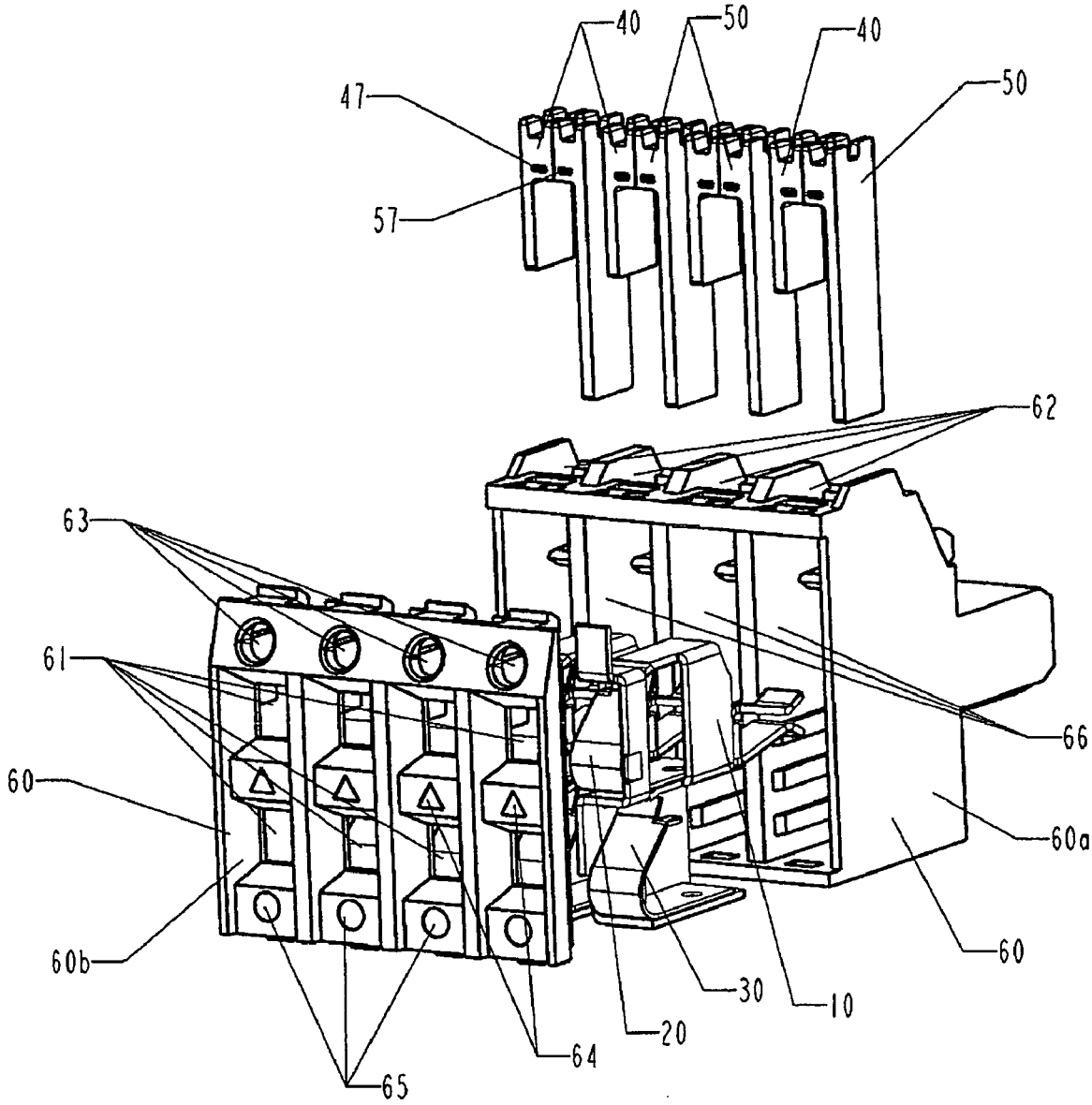
FIG. 5 is a perspective exploded view of a terminal block.
Figure 6:
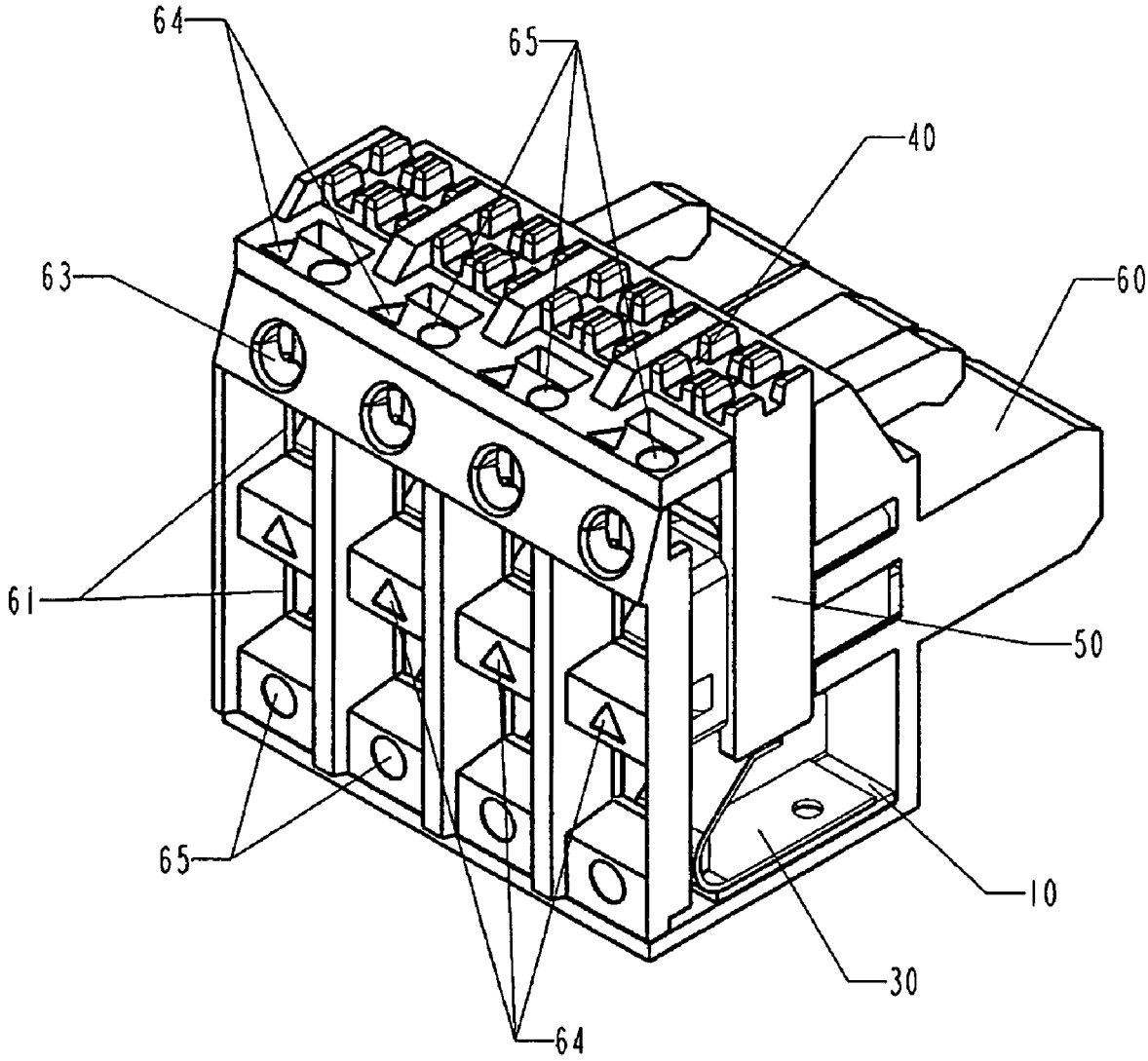
FIG. 6 is the terminal block according to FIG. 5 in the assembled state.
Figure 7:
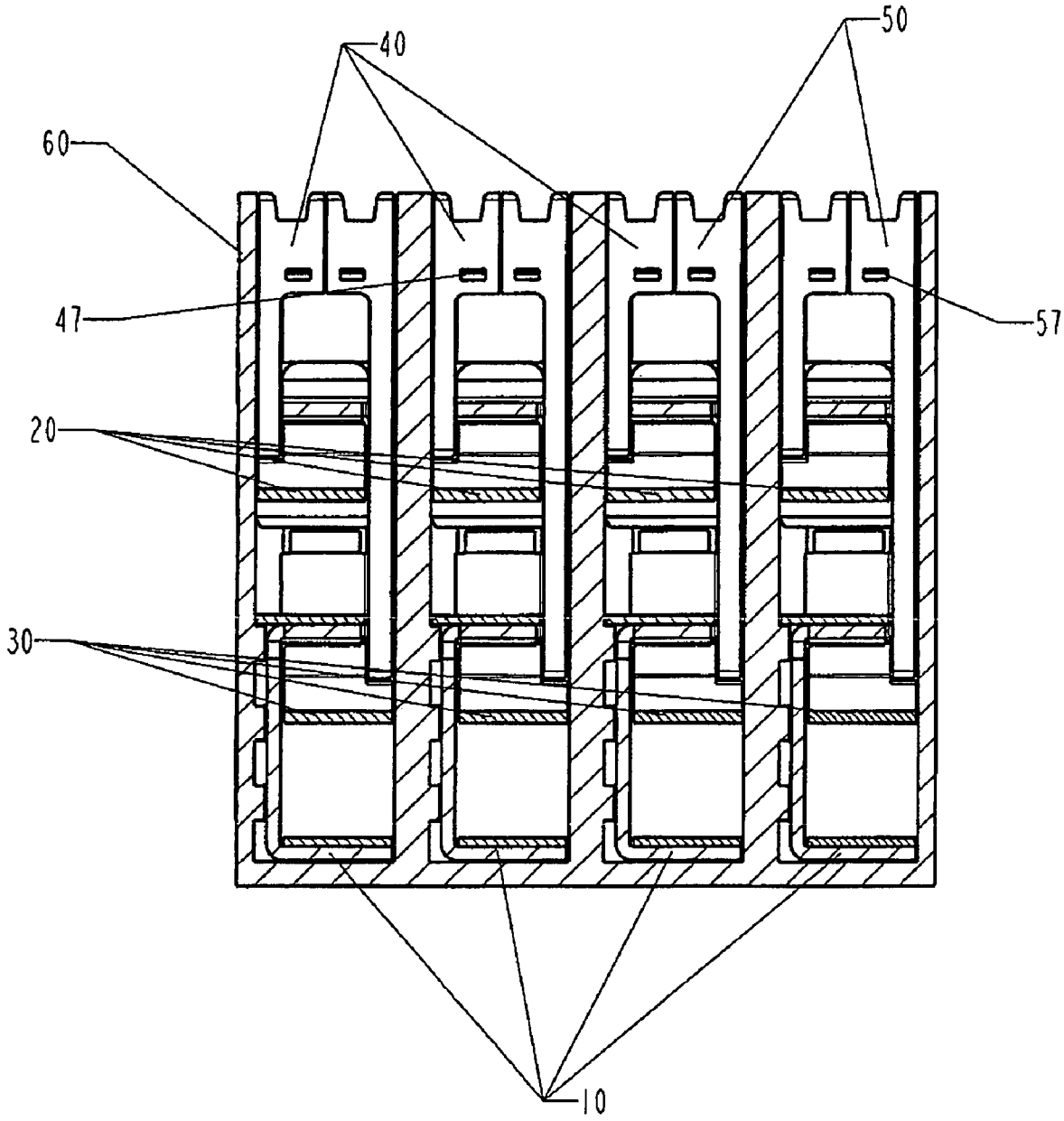
FIG. 7 is a longitudinal sectional view of the terminal block according to FIG. 6

FIG. 5 shows an exploded view of a terminal block, in which the S-shaped contact element 10 as well as the operating elements 40, 50 are inserted. FIG. 6 shows the corresponding terminal block in the assembled state with an open lateral wall, FIG. 7 shows a longitudinal sectional view of the terminal block according to FIG. 6. The terminal block according to FIG. 5 comprises a clamp housing 60, consisting of a base body 60*a* and a cover element 60*b*. The base body 60*a* has a plurality of chambers, particularly four chambers 66, in which an S-shaped contact element 10 including a first clamping spring element 20 and a second clamping spring element 30 can be inserted. By providing the S-shaped contact elements 10 in the individual chambers 66, the S-shaped contact elements 10 are insulated from each other, so that only the first and second clamping spring elements 20, 30 provided in an S-shaped contact element 10 are electrically connected to each other. The base body 60*a* is covered by the cover element 60*b*, with a feed-through opening 61 being provided in front of each clamping spring element 20, 30, through which opening an electrical conductor can be fed in the appropriate clamping point. Above the feed-through openings 61, a test opening 63 is provided such that the test surface 16 of the S-shaped contact element 10 is located behind the test opening 63 and thus accessible through the test opening 63. Above the S-shaped contact elements 10, an insertion opening 62 is provided between the cover element 60*b* and the base body 60*a* for each S-shaped contact element 10, through which opening a first operating element 40 and a second operating element 50 for each chamber 66 can be inserted. To ensure that the operating elements 40, 50 remain in the clamp housing 60, the operating elements 40, 50 each have a detent contour 47, 57, which snaps them into the clamp housing 60 after they are inserted in the clamp housing 60 and secures them against falling out.

To ensure that it is apparent which clamping spring element 20, 30 can be actuated by which operating element 40, 50 also in the assembled state of the terminal block, a first symbol 64 is provided on the outside of the clamp housing 60 in the vicinity of or on the first operating element 40 and in the vicinity of the feed-through opening 61 of the first clamping spring element 20, while a second symbol 65 is provided in the vicinity of or on the second operating element 50 and in the vicinity of the feed-through opening 61 of the second clamping spring element 30. The first and second symbols 64, 65 differ from each other. This allows an association of the respective operating element 40, 50 with the corresponding clamping spring element 20, 30.

Figure 8:
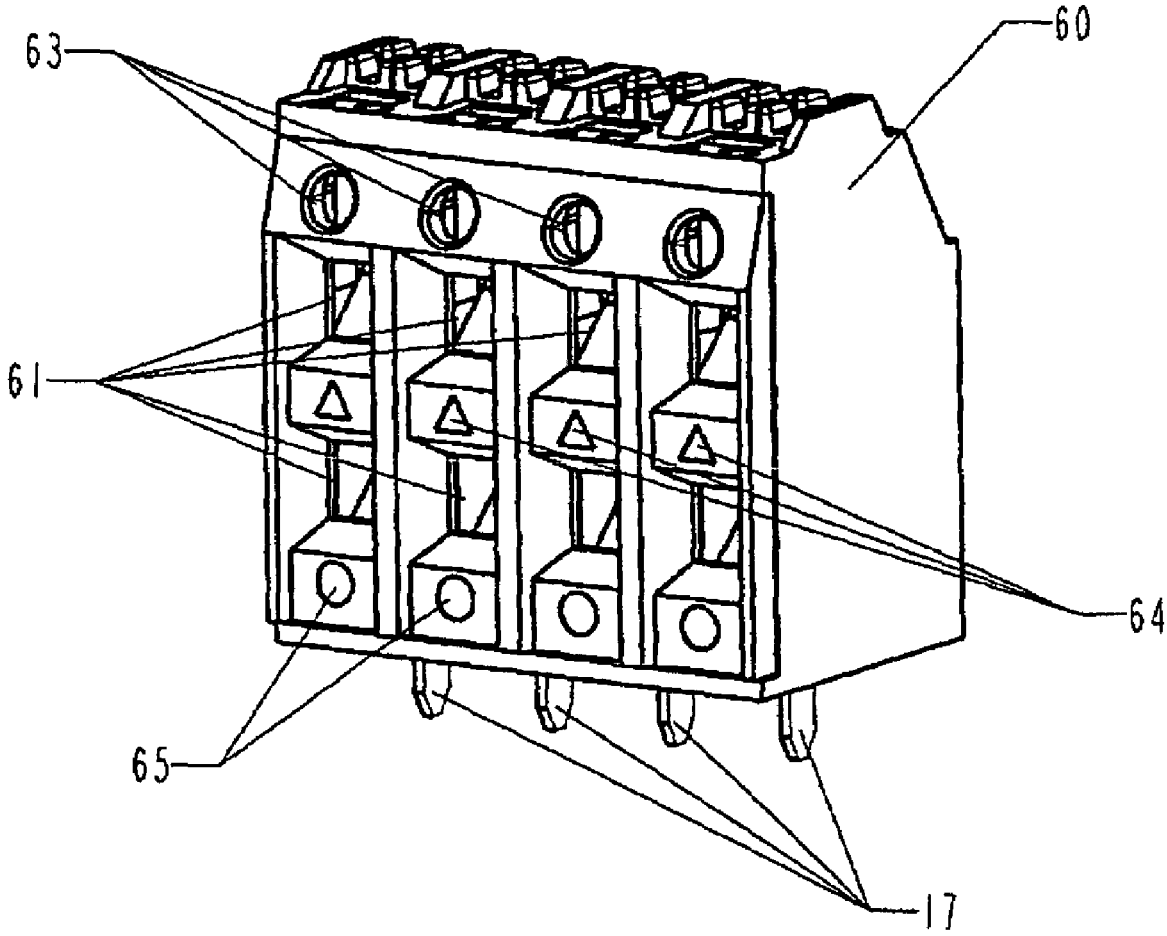
FIG. 8 is a perspective view of a further embodiment of a terminal block.

FIG. 8 shows a further embodiment of a terminal block, wherein the plug contact 15 of the S-shaped contact element 10 has been replaced with a soldering pin 17 integrally formed on the bottom of the second support surface 11*b*. As a result, the terminal block can be implemented both as a plug-in and as a soldering version. The further embodiment of the terminal block according to FIG. 8 corresponds to the embodiment described above with reference to FIGS. 1 to 7.

REFERENCE NUMERAL LIST

10 S-shaped contact element
11*a* first support surface
11*b* second support surface
12 recess
13*a* first structure
13*b* second structure
14 upper surface
15 plug contact
16 test surface
17 soldering pin
18*a* lateral surface
18*b* lateral surface
19*a* web
19*b* web
20 first clamping spring element
21 support surface
22 spring-loaded leg
23 structure

24 abutment surface
30 second spring clamping element
31 support surface
32 spring-loaded leg
33 structure
34 abutment surface
40 first operating element
44 abutment surface
45 pressure surface
46*a* first recess
46*b* second recess
47 detent contour
50 second operating element
54 abutment surface
55 pressure surface
56*a* first recess
56*b* second recess
57 detent contour
60 clamp housing
60*a* base body
60*b* cover element
61 feed-through opening
62 insertion opening
63 test opening
64 first symbol
65 second symbol
66 chamber

The invention claimed is:

1. A terminal block for connecting electrical conductors, with a first clamping spring element (20) and a second clamping spring element (30) for clamping the electrical conductors, the first and second clamping spring elements (20, 30) vertically offset from each other, and with an operating element for opening the clamping spring element against the spring force, characterized by a first operating element (40) provided for the first clamping spring element (20) and a second operating element (50) provided for the second clamping spring element (30), the first and second operating elements (40, 50) actuatable independently from each other characterized in that the two operating elements (40, 50) are disposed above the two clamping spring elements (20, 30) and one of the two operating elements (50) is guided past the upper clamping spring element (20) so as to be able to actuate the lower clamping spring element (30).

2. The terminal block according to claim 1, characterized in that the first and second clamping spring elements (20, 30) are in horizontal alignment.

3. The terminal block according to claim 1, characterized in that the first and second operating elements (40, 50) are configured as translatory pressure elements.

4. A terminal block according to claim 1, characterized in that the two operating elements (40, 50) are disposed parallel to each other.

5. A terminal block according to claim 1, characterized in that each operating element (40, 50) comprises an abutment surface (44, 54), with which it engages a corresponding abutment surface (24, 34) of the respective clamping spring element (20, 30).

6. A terminal block according to claim 1, characterized in that each operating element (40, 50) comprises a pressure surface (45, 55), with which it applies pressure for actuating the respective clamping spring element (20, 30).

7. The terminal block according to claim 6, characterized in that the pressure surfaces (45, 55) comprise a first recess (46*a*, 56*a*), in which a working point of a flat head screwdriver or similar tool can be inserted.

8. The terminal block according to claim 7, characterized in that the first recesses (46*a*, 56*a*) extend parallel to each other in the pressure surfaces (45, 55) of the two operating elements (40, 50).

9. The terminal block according to claim 7, characterized in that the pressure surface (45, 55) comprises a second recess (46*b*, 56*b*), the two second recesses (46*b*, 56*b*) of the two operating elements (40, 50) being aligned with each other when the pressure surfaces (45, 55) of the two operating elements (40, 50) abut each other.

10. The terminal block according to claim 9, characterized in that the second recesses (46*b*, 56*b*) are disposed perpendicular to the first recesses (46*a*, 56*a*).

11. A terminal block according to claim 1, characterized in that the first and second clamping spring elements (20, 30) are disposed in a common clamp housing (60), which has at least two feed-through openings (61) for feeding the electrical conductors.

12. The terminal block according to claim 11, characterized in that a plurality of first and second clamping spring elements (20, 30) are disposed in the clamp housing (60).

13. The terminal block according to claim 12, characterized in that the individual clamping spring pairs consisting of first and second clamping spring elements (20, 30) are electrically insulated from each other.

14. A terminal block according to claim 11, characterized in that the operating elements (40, 50) can be inserted in the clamp housing (60) through insertion openings (62) and have a detent contour (47, 57), by means of which they snap into the clamp housing (60).

15. A terminal block according to claim 1, characterized in that the two clamping spring elements (20, 30) are electrically connected to each other.

16. The terminal block according to claim 15, characterized in that the two clamping spring elements (20, 30) are electrically connected to each other via a contact element (10).

17. The terminal block according to claim 16, characterized in that the contact element (10) is configured to be S-shaped, with one clamping spring element (20, 30) each being insertable in the contact element (10) from the two lateral surfaces.

18. The terminal block according to claim 17, characterized in that the S-shaped contact element (10) is configured as one piece.

19. The terminal block according to claim 17, characterized in that the S-shaped contact element (10) is configured as a stamped and bent element.

20. A terminal block according to claim 17, characterized in that the S-shaped contact element (10) is made of electrically conductive metal.

21. A terminal block according to claim 1, characterized in that the clamping spring elements (20, 30) are configured as leaf springs.

22. A terminal block according to claim 17, characterized in that the clamping spring elements (20, 30) rest against a support surface (11*a*, 11*b*) of the S-shaped contact element (10) with a support surface (21, 31).

23. The terminal block according to claim 22, characterized in that the support surfaces (12, 31) of the clamping spring elements (20, 30) have structures (23, 33), with which they engage correspondingly shaped structures (13*a*, 13*b*) of the support surfaces (11*a*, 11*b*) of the S-shaped contact element (10).

24. A terminal block according to claim 17, characterized in that on the S-shaped contact element (10) a plug contact (15) or a soldering pin (17) is provided.

25. A terminal block according to claim 17, characterized in that on the S-shaped contact element (10) a test surface (16) is provided.

26. A terminal block according to claim 17, characterized in that the S-shaped contact element (10) in its upper region comprises a recess in which the operating element (50) for the lower clamping spring element (30) is guided.

27. A terminal block according to claim 11, characterized in that graphical symbols (64, 65) are provided on the clamp housing (60) in the vicinity of or on the operating elements (40, 50) and in the vicinity of the feed-through opening (61) of the corresponding clamping spring element (20, 30), which symbols enable the association of the operating element (40, 50) with the respective clamping spring element (20, 30).

* * * * *